US006655323B2

(12) United States Patent
Inoue

(10) Patent No.: US 6,655,323 B2
(45) Date of Patent: Dec. 2, 2003

(54) BOILER INCIDENTAL FACILITY

(76) Inventor: Seiji Inoue, 15-22-501, Sakou 3-chome, Nishi-ku, Nagoya-shi, Aichi 451-0052 (JP)

( * ) Notice: Subject to any disclaimer, the term of this patent is extended or adjusted under 35 U.S.C. 154(b) by 0 days.

(21) Appl. No.: 10/153,432

(22) Filed: May 21, 2002

(65) Prior Publication Data

US 2002/0195066 A1 Dec. 26, 2002

(30) Foreign Application Priority Data

Jun. 14, 2001 (JP) ..... 2001-179560

(51) Int. Cl.[7] ..... F22D 7/04
(52) U.S. Cl. ..... 122/404; 122/401; 122/405
(58) Field of Search ..... 122/404, 405, 122/401; 110/205, 206, 207, 215

(56) References Cited

U.S. PATENT DOCUMENTS 4,925,640 A * 5/1990 Morii et al. ..... 423/239.1

FOREIGN PATENT DOCUMENTS

JP 09-236205 9/1997 ..... F22B/37/52
JP 2001-108215 4/2001 ..... F23G/5/14

* cited by examiner

*Primary Examiner*—Jiping Lu
(74) *Attorney, Agent, or Firm*—Darby & Darby

(57) ABSTRACT

A boiler incidental facility includes at least one jet nozzle, equipped in an air supply duct or an air exhaust duct connected with a furnace. During operation, steam is heated and supplied to the jet nozzle and spurted in a direction in alignment with an air flow in an air supply duct or in an air exhaust duct. Reactive and meditative chemicals may be injected into the air flow either through the net nozzles or adjacent to the net nozzles.

12 Claims, 3 Drawing Sheets

BOILER INCIDENTAL FACILITY

BACKGROUND OF THE INVENTION

1. Field of the Invention

The present invention relates to a boiler incidental facility which improves efficiency of supplying or exhausting air.

2. Description of the Related Art

Referring now to FIG. 2, a boiler 1 includes an air supply fan 3 and an air exhaust fan 4. A unit 2 is a functional element such as a filter or a damper. During operation, in order to stoke-up boiler 1, it is necessary to circulate a large amount of combustion air. Consequently both air supply fan 3 and air exhaust fan 4 require high capacity and correspondingly large amounts of electrical power. Additionally, for effective operation additional power is required to rotate a swing cascade (not shown) for each fan 3, 4.

As an additional detriment to operation, fans 3, 4 generate self-excited vibration due to aerodynamic and other specific operational conditions. These vibrations limit the operable range for fans 3, 4. The swing cascade for fans 3, 4, also necessitates support bearings which detrimentally influence operational energy loss and the mechanical life of each support bearing. The use of swing cascades for each fan (with rotating portions) necessitates a high degree of manufacturing accuracy and on-going maintenance.

OBJECTS AND SUMMARY OF THE INVENTION

It is an object of the present invention to provide a boiler incidental facility which overcomes the detriments of the above art.

It is another object of the present invention to provide a boiler incidental facility, including a jet nozzle equipped in an air supply duct or an air exhaust duct connected with a furnace, wherein steam is heated and supplied to the jet nozzle and spurted in the direction in alignment with an air flow in said air supply duct or air exhaust duct.

It is another object of the present invention to promote an air or gas flow in ducts by employing a jet nozzle by spurting steam into an accompanying duct air flow and consequently securing the quantity of air required for a boiler.

It is another object of the present invention to provide a boiler incidental facility which further includes: a medicine pouring system which pours chemical materials into the steam supplied to the jet nozzle in order to neutralize or extract air-polluting materials contained in exhaust gases from a furnace, or in the case where the medicine pouring system is equipped near the jet nozzle and pours chemical materials into exhaust air, the jet nozzle spurts steam at a high speed, and chemical materials are sufficiently mixed with the steam and the exhaust gas in the duct to promote a chemical reaction.

It is another object of the present invention to support a boiler incidental facility with an incinerator used as the furnace.

It is another object of the present invention to support a boiler incidental facility having a plurality of jet nozzles in a gas supply duct. Here, the accompanying effect of the air or gas in the duct by the steam spurted from the jet nozzle is enhanced, the controllability and the efficiency of supplying air are improved as a system.

The present invention relates to a boiler incidental facility having at least one jet nozzle, equipped in an air supply duct or an air exhaust duct connected with a furnace. During operation, steam is heated and supplied to the jet nozzle and spurted in a direction in alignment with an air flow in an air supply duct or in an air exhaust duct. Reactive and meditative chemicals may be injected into the air flow either through the net nozzles or adjacent to the net nozzles.

According to an embodiment of the present invention, there is provided, a boiler incidental facility, comprising: at least one jet nozzle and the jet nozzle in one of an air supply duct or an air exhaust duct connected with a furnace, wherein steam is heated and supplied to the jet nozzle and spurted in a direction in alignment with an air flow in the one of the air supply duct and air exhaust duct during an operation of the boiler incidental facility.

According to another embodiment of the present invention, there is provided a boiler incidental facility, further comprising: a chemical pouring system and the chemical poring system positioned to inject a supplied chemical material into the steam delivered to the jet nozzle and being effective to perform one of a neutralization or an extraction of an air-polluting material contained in the exhaust gas from the furnace during an operation of the chemical pouring system.

According to another embodiment of the present invention, there is provided, a boiler incidental facility, further comprising: a chemical pouring system and the chemical pouring system proximate the jet nozzle in the one of the air supply duct and the air exhaust duct, positioned to enable effective application of a chemical material to perform one of a neutralization or an extraction of an air-polluting material contained in the exhaust gas from the furnace during an operation o f the chemical pouring system.

According to another embodiment of the present invention, there is provided a boiler incidental facility, wherein the furnace is an incinerator.

According to another embodiment of the present invention, there is provided a boiler incidental facility, wherein a plurality of the jet nozzles are equipped in the one of the air supply duct and the air exhaust duct.

The above and other objects, features, and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
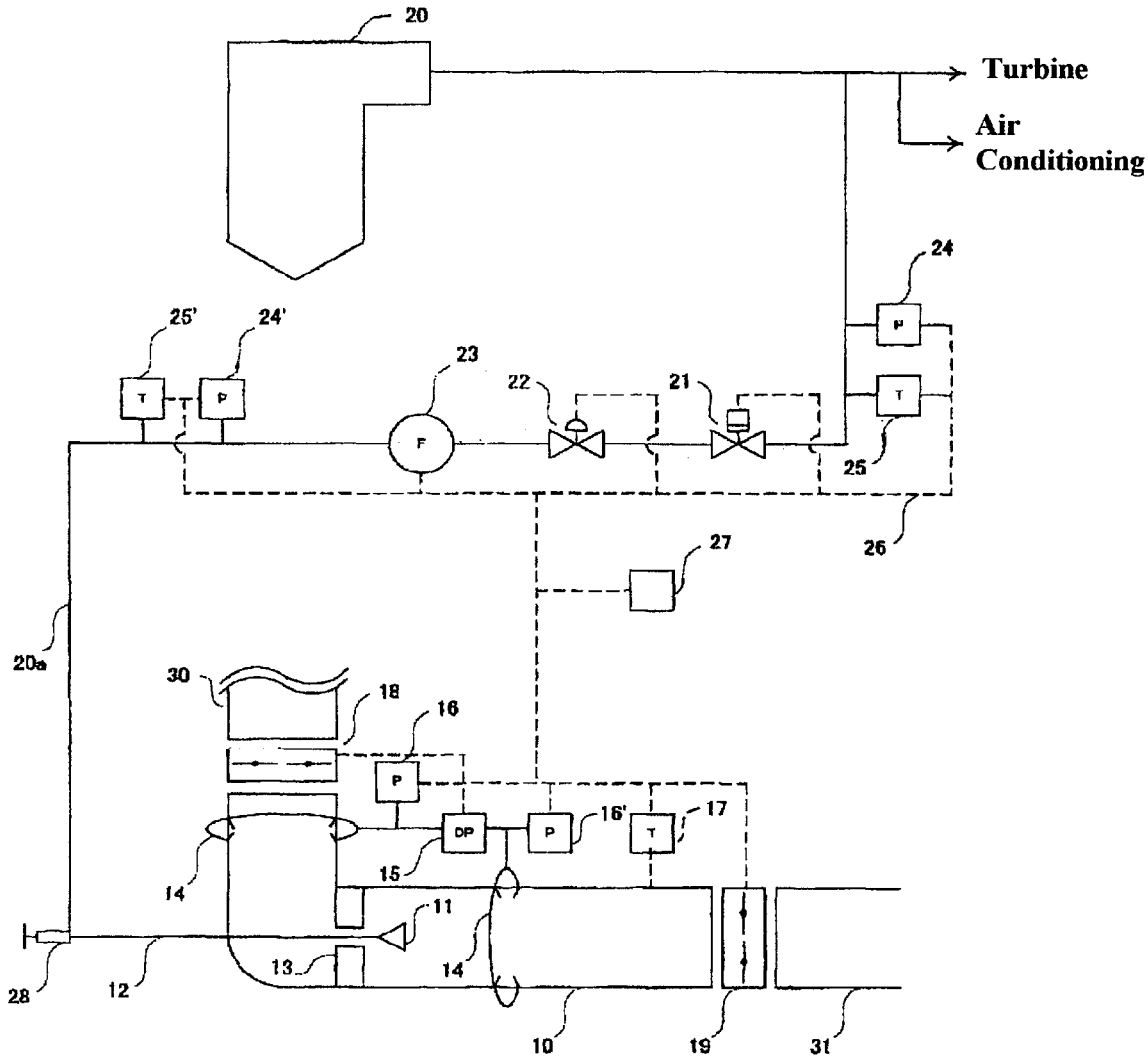
FIG. 1 is a schematic diagram of a boiler according to an embodiment of the present invention.
Figure 2:
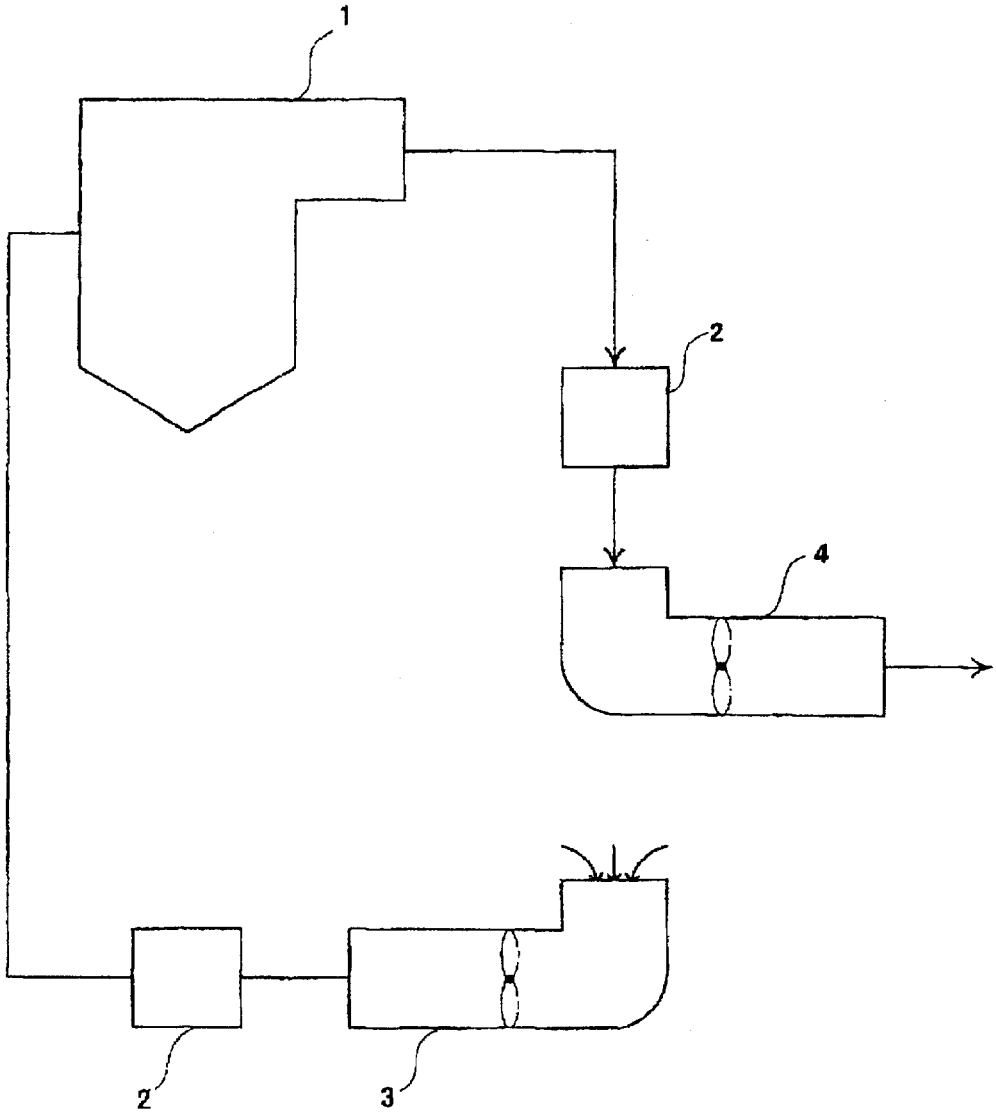
Fig. 2 Prior Art
FIG. 2 is a schematic diagram of a conventional boiler.

Referring now to FIG. 1, a casing 10 encloses a part of an air exhaust duct from a boiler 20 or a part of an air supply duct to boiler 20. During operation, a jet nozzle 11, inside casing 10, spurts steam in a direction from an upstream duct 30 toward a down stream duct 31. A steam piping 12 fixes jet nozzle 11 in casing 10 adjacent a support 13. During operation, steam piping 12 supplies steam from boiler 20 to jet nozzle 11.

Steam piping 12 connects with a steam piping 20*a* at a connecting port 28. Steam piping 20*a* leads steam from boiler 20 through steam piping 12 to jet nozzle 11 and enables steam spurting into casing 10. Since more steam is produced than is needed at jet nozzle 11, additional steam is used for other elements of the facility, of example a turbine drive.

Through this arrangement, high pressure steam from boiler 20 is spurted through jet nozzle 11 in a direction in alignment with an air flow in casing 10. During an operation of the present invention, when steam is spurted by jet nozzle, the steam joins the gas or air in its immediate surrounding and a gas or air flow in casing 10 is thereby promoted further supplying air to boiler 20 and fans (not shown) in casing 10.

For the above reasons, it is preferable that support 13 has a shape with the lowest air pressure (or air resistance) possible in order to minimize obstructions to the flow of supplied or exhausted air in casing 10.

During operation, the flow of supplied or exhausted air by jet nozzle 11 may be controlled to a degree, by adjusting the flow of steam supplied to jet nozzle 11. It is additionally preferable, but not required, to position a plurality of jet nozzles 11 in casing 10 and control steam supply for each through a simple on/off type button.

As noted above, the present invention provides during operation that jet nozzle 11 spurts steam in order to increase the speed of a flow of air or gas around the spurted steam. This increase in speed is an important effect of the present invention and allows jet nozzle 11 (or a set of such nozzles) to operate as a fan. Therefore, a relationship between a minor diameter of casing 10 and a major diameter of jet nozzle 11, and spurting pressure are important to understand and manage in order to maximize the desired output of the invention. This issue is especially important since where the minor diameter of casing 10 is too great compared to the major diameter of jet nozzle 11, the effect of jet nozzle 11 as a fan is decreased.

In order to compensate for a decrease of the 'fan-effect', it is effective to increase the number of jet nozzles 11 in order to lessen a ratio between the minor diameter of casing 10 and an effective diameter of jet nozzle 11. In other words, it is desirable, but not mandatory to bring this ration close to 1.

A shut off valve 21 is in a middle section of steam piping 20*a* and controls a steam supply to jet nozzle 11 during operation. A control valve 22 is located operably adjacent shut off valve 21 and provides easy control of the flow of steam supplied to jet nozzle 11.

A steam flow meter 23, a steam pressure indicator 24, and a steam temperature indicator 25 are also in steam piping 20*a* extending from steam piping 12. In combination, these devices measure the respective characteristics of a steam flow through steam piping 20*a,* 12. An alternatively or additionally positioned steam pressure indicator 24', and steam temperature indicator 25' may be placed as needed by a customer (as shown).

A differential pressure gauge 15 measures pressure of the air, exhaust air, or other item in ducts 10, 30 through respective pressure indicating pipes 14, 14. A pressure indicator 16 and a temperature indicator 17 also measure respective characteristics of the air, exhaust air, or other item in the casing as shown. An alternative pressure indicator 16' is shown in an alternative or additional position depending upon manufacturer need.

Characteristics of steam, air and/or exhaust air, measured by each respective measuring gauge shown, is transmitted to a field or a central control panel 27 through a control signal cable 26.

During operation, the flow and pressure of steam supplied to jet nozzle 11 are controlled by control valve 22, which is in-turn controlled by control panel 27.

The flow and pressure of supplied or exhaust air in upstream duct 30 and downstream duct 31 are controlled by the flow and pressure of steam from an upstream damper 18, a downstream damper 19 and jet nozzle 11, which are controlled by control panel 27.

Where casing 10 comprises an air exhaust duct from boiler 20, according to need, chemical materials for neutralizing or extracting air-polluting materials contained in exhaust gas may be poured from connecting port 28, equipped in the middle of steam piping 12.

Figure 3A:
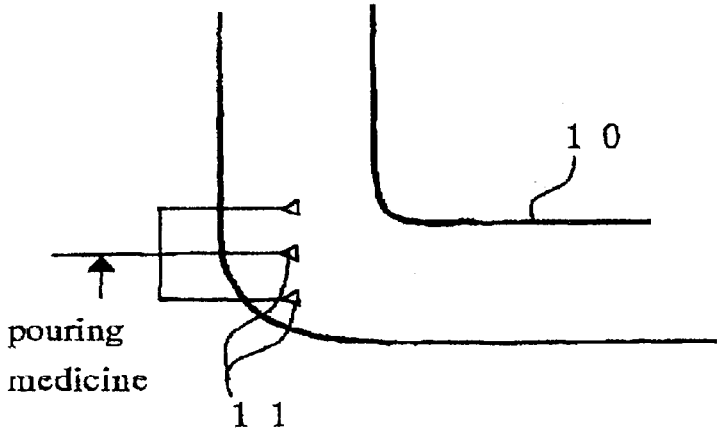
FIG. 3(A) is a schematic diagram of an embodiment of the present invention having a plurality of jet nozzles which receive medicine during a use.
Figure 3B:
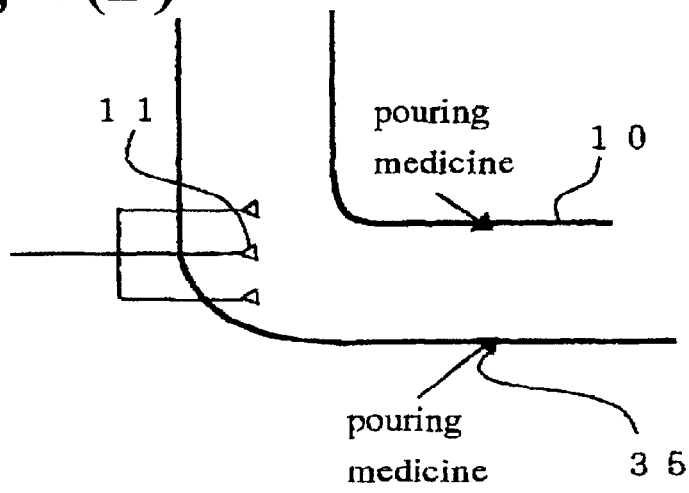
FIG. 3(B) is a schematic diagram of an embodiment of the present invention having a plurality of jet nozzles, where medicine is applied down on a stream side.
Figure 3C:
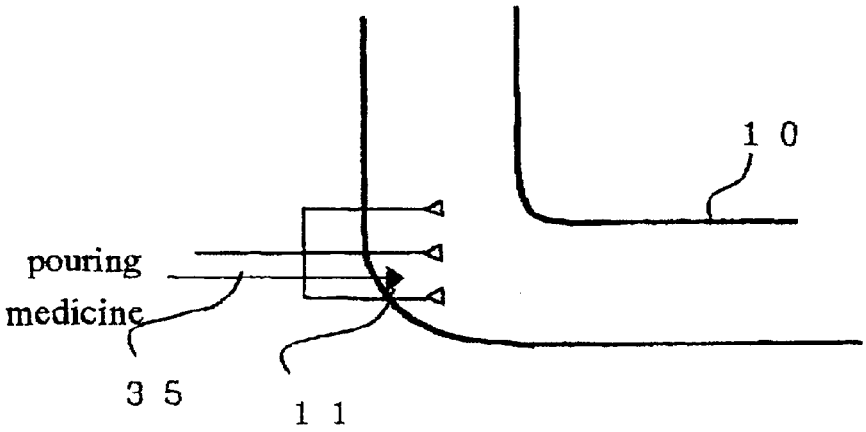
FIG. 3(C) is a schematic diagram of an embodiment of the present invention having a plurality of jet nozzles, where medicine is applied adjacent the plurality.

Additionally referring now to FIGS. 3(A), 3(B), and 3(B), a plurality of jet nozzles 11 are shown in detailed arrangements within casing 10 and in operation with a medicine pouring system 35, which may be positioned in alternative areas for best effect. In this embodiment, each jet nozzle 11 is connected with a flow control valve and a shutoff valve (both not shown in FIGS. 3(A)–3(C).

As mentioned above, many chemical materials, for example air-purifying medicine, may be poured into the steam issuing from jet nozzle 11. However, apart from jet nozzle 11, many other types of chemicals or medical materials may be positioned in alternative medicine pouring systems 35, and supply chemicals into either the supplied or exhausted air.

During operation, as jet nozzle 11 spurts steam into casing 10 at high speed, steam spurts from jet nozzle 11 and is mixed with air or gas around the steam at a high speed. Therefore, the chemical materials supplied into steam piping 12 are spurted from jet nozzle 11 into exhaust air at high speed, and consequently mixed with the exhaust air effectively, and thus the efficiency of neutralizing or extracting air-polluting materials contained in exhaust gas is improved remarkably. This ability to maximize mixture throughout the air supply through the use of high speed steam jet nozzles is remarkable effective in dispersion and hence treatment.

As mentioned in the above embodiment of the present invention, where jet nozzle 11 spurts high pressure steam from boiler 20 in the downstream direction, the same or a greatly improved dispersive effect is expect contrary to cases where fans are equipped in casing 10. As noted above, in related are situations where air is urged by fans, detrimental surging, abnormal vibration due to wing cascade and other effects occurs in accordance with a combination of balance between the flow and the pressure in the casing. In the above embodiment of the present invention, there is no wing cascade and no possibility to cause surging or detrimental efficiency issues.

As an additional benefit of the present invention, machine parts including bearings for supporting rotation of the wing cascade are eliminated reducing costs and maintenance and since there are no moving parts, there is no mechanical energy loss.

Further, although exhaust air from boiler 20 contains air-polluting materials such as NOx, SOx, CO and $CO_2$, the air pollution can be easily reduced, as above mentioned, by equipping jet nozzle 11 in the exhaust air duct to pour neutralizing chemical materials such as $NH_3$ and $Ca(OH)^2$ into steam piping 12 to cut emissions and allow easy down-stream extraction.

Furthermore, the great quantity of electrical energy required for high pressure rotating wing cascades is eliminated. It should be understood, that in the above embodiment of the present invention, wing cascades are not used and sending air and changing pressure are conducted by spurting high temperature and high-pressure steam produced in boiler 20 through the casings. In this respect, the electric energy required in the prior art is converted from steam energy produced in boiler 20. Therefore, the present invention provides greater efficiency of energy, by using steam energy directly.

While the present invention relates to a boiler that produces steam, a furnace used in the present invention may be an incinerator.

As mentioned above, the present invention provides a boiler incidental facility, comprising a jet nozzle which is equipped in an air supply duct or an air exhaust duct connected with a furnace, wherein steam is heated and supplied to the jet nozzle or jet nozzles for spurting in a direction in alignment with an air flow in the air supply duct or air exhaust duct. In this manner, in the ducts equipped with the jet nozzle, air flow accompanying the steam spurted from the jet nozzle forms, and an air flow or a gas flow in the duct is promoted. Consequently, this increase in air flow increases the efficiency of combustion in a boiler.

Where a boiler incidental facility further comprises a medicine pouring system designed to supply chemical materials into the steam supplied to the jet nozzle, neutralization or extraction of air-polluting materials contained in the exhaust gas from the furnace, is easily accomplished. The highly effective mixing between the air and the chemical materials promotes the reaction of the chemical materials. This same effect is also achievable where the medicine pouring system is positioned near, but not in, the jet nozzle. Furthermore, an incinerator may be used as the furnace.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims. In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies entirely on friction between a wooden part and a cylindrical surface, a screw's helical surface positively engages the wooden part, and a bolt's head and nut compress opposite sides of at least one wooden part, in the environment of fastening wooden parts, a nail, a screw, and a bolt may be readily understood by those skilled in the art as equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A boiler incidental facility, comprising:

at least one jet nozzle located in an air supply duct and/or an air exhaust duct wherein a furnace is connected and an air flow is increased by an accompanying air flow caused by a high speed flow of steam which is heated by said furnace and is supplied and spurted through said jet nozzle in a direction of said air flow in said air supply duct and/or said air exhaust duct during an operation of said boiler incidental facility.

2. A boiler incidental facility, according to claim 1 further comprising:

a chemical pouring system; and said chemical poring system positioned to inject a supplied chemical material into said steam delivered to said jet nozzle and being effective to perform one of a neutralization or an extraction of an air-polluting material contained in said exhaust gas from said furnace during an operation of said chemical pouring system.

3. A boiler incidental facility according to claim 2, wherein said furnace is an incinerator.

4. A boiler incidental facility according to claim 3, wherein a plurality of said jet nozzles are equipped in said one of said air supply duct and said air exhaust duct.

5. A boiler incidental facility according to claim 2, wherein a plurality of said jet nozzles are equipped in said one of said air supply duct and said air exhaust duct.

6. A boiler incidental facility, according to claim 1, further comprising:

a chemical pouring system; and said chemical pouring system proximate said jet nozzle in said one of said air supply duct and said air exhaust duct, positioned to enable effective application of a chemical material to perform one of a neutralization or an extraction of an air-polluting material contained in said exhaust gas from said furnace during an operation of said chemical pouring system.

7. A boiler incidental facility according to claim 6, wherein said furnace is an incinerator.

8. A boiler incidental facility according to claim 7, wherein a plurality of said jet nozzles are equipped in said one of said air supply duct or in said air exhaust duct.

9. A boiler incidental facility according to claim 6, wherein a plurality of said jet nozzles are equipped in said one of said air supply duct and said air exhaust duct.

10. A boiler incidental facility according to claim 1, wherein said furnace is an incinerator.

11. A boiler incidental facility according to claim 10, wherein a plurality of said jet nozzles are equipped in said one of said air supply duct and said air exhaust duct.

12. A boiler incidental facility according to claim 1, wherein a plurality of said jet nozzles are equipped in said one of said air supply duct and said air exhaust duct.

* * * * *